United States Patent [19]

Babitzka

[11] Patent Number: 4,479,475

[45] Date of Patent: Oct. 30, 1984

[54] PRESSURIZED FUEL INJECTION SYSTEM FOR MULTI-CYLINDER ENGINES, PARTICULARLY DIESEL ENGINES

[75] Inventor: Rudolf Babitzka, Kirschberg, Fed. Rep. of Germany

[73] Assignee: Robert Bosch GmbH, Stuttgart, Fed. Rep. of Germany

[21] Appl. No.: 445,091

[22] Filed: Nov. 29, 1982

[30] Foreign Application Priority Data

Dec. 9, 1981 [DE] Fed. Rep. of Germany ..... 3148671

[51] Int. Cl.[3] ..... F02M 41/02; F02M 39/00

[52] U.S. Cl. ..... 123/446; 123/451; 123/458

[58] Field of Search ..... 123/500, 501, 502, 506, 123/451, 446, 447, 458, 457

[56] References Cited

U.S. PATENT DOCUMENTS

| | | | |
|---|---|---|---|
| 3,308,794 | 3/1967 | Bailey | 123/446 |
| 3,465,737 | 9/1969 | Dreisin | 123/502 |
| 3,486,493 | 12/1969 | Dreisin | 123/501 |
| 4,387,686 | 6/1983 | LeBlanc et al. | 123/446 |
| 4,388,908 | 6/1983 | Babitzka | 123/446 |
| 4,398,518 | 8/1983 | LeBlanc et al. | 123/446 |
| 4,398,519 | 8/1983 | Tissot | 123/446 |
| 4,438,363 | 3/1984 | Babitzka | 310/328 |

FOREIGN PATENT DOCUMENTS

| | | | |
|---|---|---|---|
| 57942 | 7/1946 | Netherlands | 123/451 |

*Primary Examiner*—Charles J. Myhre
*Assistant Examiner*—Carl Stuart Miller
*Attorney, Agent, or Firm*—Frishauf, Holtz, Goodman & Woodward

[57] ABSTRACT

To provide for a compact and readily controlled injection system, so that initiation of fuel injection, and termination thereof can be electrically controlled, and independently of mechanical injection control pressure, and to provide for use of only a single connection line between a fuel supply (33–36; 32–41) and the respective injection valves (11–14), a piezo-electrically controlled control valve (38, 59) interposed between two each injection valves, which are, each operated by cams (2–5) to provide injection pressure. The injection valves (38, 39) permit communication, or blocking of the respective single lines (30, 31, 39, 40) from the fuel supply lines (32, 41), which will then function both as fuel supply, as well as overflow and drain lines. The cams (25) of paired valves are so arranged and offset that when one of the paired valves is commensing its injection stroke, the other one of the paired valves is moving into its OFF position. Actual injection time is controlled by a piezo-electric-hydraulic servo piston, of substantially larger diameter than the spool (45) of the spool valve injection control valve, to move the spool between communication line closing, or blocking, and communicating positions in accordance with electrical signals applied to the electrical positioning transducer. Thus, the cams mechanically control the longest possible injection stroke, the electrical signals permitting, however, selectively communication with the fuel supply system to provide, as required, selectively fuel supply to the injection valves, or otherflow therefrom when the spool of the valve establishes communication, whereas, when the spool blocks, fuel is being injected through the injection valve.

9 Claims, 4 Drawing Figures

Figure 1:
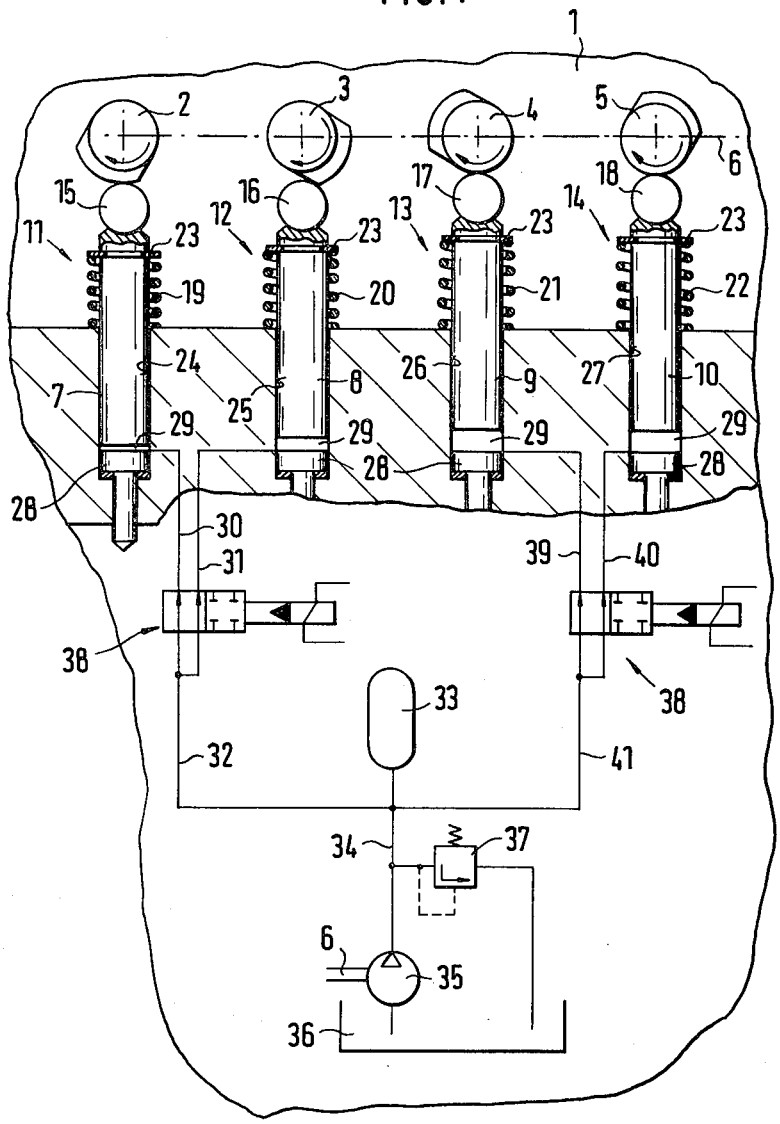

PRESSURIZED FUEL INJECTION SYSTEM FOR MULTI-CYLINDER ENGINES, PARTICULARLY DIESEL ENGINES

Reference to related patents:

U.S. Pat. No. 3,465,737, Dreisin,

U.S. Pat. No. 3,486,493, Dreisin.

Reference to related applications assigned to the asignee of this application and incorporated herein:

U.S. Pat. No. 311,677, Oct. 15, 1981, Babitzka et al now U.S. Pat. No. 4,438,363.

The present invention relates to a fuel injection system for an internal combustion engine and more particularly to a fuel injection system for a multi-cylinder internal combustion engine in which injection valves, for example valve-nozzle combinations inject fuel into the combustion chamber of the engine when the fuel is subject to a pressure pulse.

BACKGROUND

It has previously been proposed—see the referenced U.S. Pat. Nos. 3,465,737 and 3,486,493, Dreisin—to so construct fuel injection systems in which an injection nozzle injects fuel, that the quantity is determined by a hydraulically controlled operating element, introduced in a drain or return line from pressurized fuel being applied to the injection nozzle. The control element, or control slider, controls the effective supply stroke, and thus the quantity of fuel being injected by the injection nozzle pump, by selectively blocking, or clearing the fuel return line from the pump working chamber. This fuel injection apparatus utilizes the control system which is the same for all the injection pumps, and uses a rotary distributor operating in synchronism with the cam shaft of the engine with which the system is being used. The rotary distributor determines the initiation as well as the termination of the fuel injection event. A control sleeve, which is slideable in dependence on the position of centrifugal weights provides for speed-dependent change of the initiation time of fuel injection. The rotary distributor simultaneously acts as a distributor to supply the control fluid to the respective pressure chambers of the control slider or control elements.

A control system of this type, which is mechanically driven, is highly dependent on speed. The quantity of fuel which is injected thus depends, upon changing speed, and on the speed, although the positioning elements were not changed. Such control systems are applicable for high speed engines only to a limited extent. The control fluid pressure line, as well as the fluid line may cause mutual interference, which is difficult to separate, and, if it occurs, undesirably influences control of the quantity of fuel as well as the respective time element of injection.

The earlier Dreisin U.S. Pat. No. 3,465,737 describes a fuel injection system which is similar to that discussed immediately above; a control element or control slider, however, is driven by a separate injection pump forming a control pump, and driven together with the pump nozzle combinations. Change of the timing of initiation of injection is accomplished by providing an injection adjustment element which is included in the drive for the control pump and which transfers a signal representative of drive torque. The arrangement requires much apparatus and, thus, space for its installation.

It has also been proposed in a few injection systems to include a valve element with a magnetic valve arrangement. The injection valve-nozzle combinations themselves are controlled by a magnetic valve. The magnetic valve arrangement is formed as a control slider included in a return, or overflow line. Each one of the injection valve-nozzle combinations have such a magnetic valve associated therewith, which directly affect the injection pressure level. It is extremely difficult to make magnetic valves such that they are all precisely identical, and tolerances of the respective valves, and particularly their operation bases on the applied pressure levels may vary. Thus, if these systems are included in a multi-cylinder engine, the respective cylinders of the engine may not receive the same quantity of fuel from the fuel injection elements, although, from a theoretical design point of view the fuel should be the same. Due to operating tolerances, however, which are practically unavoidable, they may not be.

THE INVENTION

It is an object to provide a fuel injection system in which control of initiation of injection, and injection duration is easily and accurately controlled, and which is compact and readily adapted to diesel engines operating at high speed, for example, diesel engines utilized in automotive applications.

Briefly, an electrically controlled control valve is hydraulically connected in the connection line which supplies fuel from a fuel supply system to at least two injection valves. The control valve comprises, in accordance with a feature of the invention, a spool valve, the valve spool of which is moveable between two positions, respectively placing the connection lines of the at least two valves between the fuel supply and the injection valves either in open, hydraulically communicating, or closed, hydraulically blocked state. An electrical positioning control element, typically a piezo-electric positioning element is provided moving the valve spool to the respective first, or second positions, for example by a hydraulic positioning control piston operable by the electrically controlled positioned element. A mechanical drive, such a cam drive is coupled to valve pistons of the at least two injection valves. The drive, and cams thereof are so arranged and timed that during the injection pulse only one of the valve pistons of the injection valves is moved to provide for fuel injection therefrom, the other one not being operated. The electrically controlled position control element thus controls, respectively, blocking and timed unblocking of the hydraulic communication lines between the fuel system and the at least two valves, timed unblocking permitting draining, or overflow in advance of termination of the injection pulse so that, although the cam operating the injection valves provides a continued injection pressure, the fluid line can be drained through the opened electrically controlled valve.

The system has the advantage that, within the mechanically predetermined pressure phases of the injection valve-pump combinations, the initiation of injection, as well as the injection duration can be varied within a wide range. Extremely short response times for injection, with wide variations of overall injection time thus can be achieved. Yet, since only one control valve is needed for two injection valves, and only a single fluid line need be connected to the respective fuel injection valves, the overall requirement of materials and assembly are low.

In accordance with a preferred feature of the invention, the mechanical injection stroke is held constant over the maximum longest possible injection range, by so shaping a control cam that it rapidly removes an injection piston to provide the pressure pulse, and then remains in the pulse-generating position. During that time, however, the cam controlling injection pressure of the second valve which is connected to the same electrically controlled positioning valve is in OFF position, that is, at a cam position at which low fuel is to be injected. Thus, each one of the injection valves only requires a single line for connection of fuel thereto from a fuel supply which, preferably, is supplied at a small or low pressure, just enough to insure complete filling of all cylinders and proper operation. The structure of the required pump-injection nozzle element thus is simple.

DRAWINGS

FIG. 1 is a schematic side view, partly in section, partly in diagramatic form of injection pumps for a four-cylinder diesel engine;

FIG. 2, in two graphs denoted

Figure 2A:
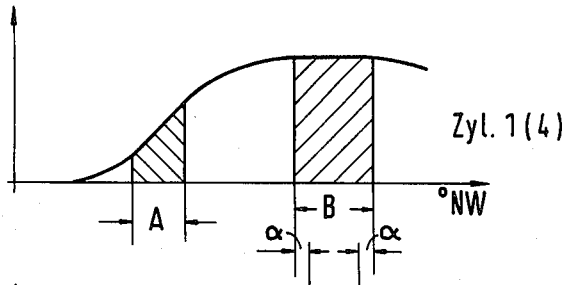
Figure 2B:
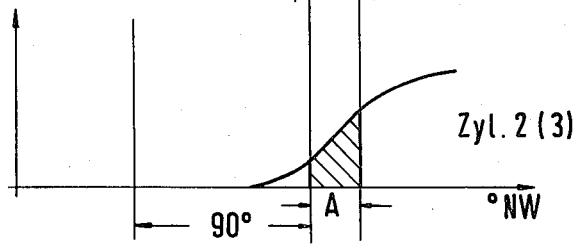
Figure 3:
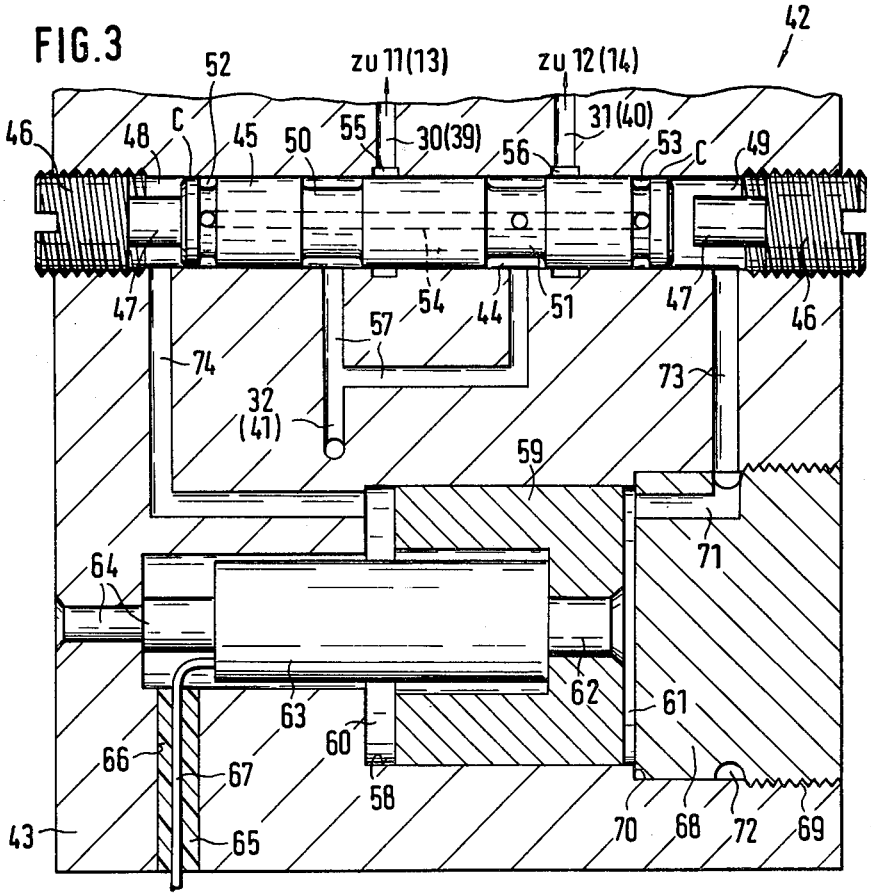

FIGS. 2A and 2B shows cam operation, with respect to crank shaft angle (abscissa) for two respectively offset control cams to drive the injection pump pistons of two paired injection valves; and FIG. 3 is a schematic cross-sectional view through a piezo-hydraulic control block having a valve slider spool to control two injection nozzle-pump combinations.

The invention will be illustrated in connection with a four cylinder diesel engine. Four operating cams 2, 3, 4, 5 are secured to the engine cam shaft 6 to drive pump pistons 7, 8, 9, 10 of injection valves 11, 12, 13, 14. Movement of the cams 2–5 is transferred to the respective pistons via roller elements 15, 16, 17, 18. Valve springs 19–22, bearing against end washers 23 of the pistons hold the respective rollar elements 15–18 reliably in engagement between the respective upper ends of the pistons and the camming surfaces of cams 2–5.

The pumps 11–14 include cylinders 24, 25, 26, 27, within which the pistons 7– slide. Fuel injection nozzles 28 are placed in hydraulic communication with the piston space, to introduce fuel into the combustion chamber of the diesel engine. A pump operating space or chamber 29 of the respective injection pumps 11–14 will be defined between the upper end of the connecting elements for the injection nozzle 28 and lower surface of the respective pistons 7–10 of the pumps 11–14.

The pump chambers or spaces 29 of the pumps 11 and 12 are connected over respective connecting ducts 30, 31 to a fuel connecting line 32, which, simultaneously, forms a fuel supply and overflow lines. Fuel is connected to the lines 30, 31 by a connecting line 32 which is in communication with a storage tank 33. The fuel within the storage tank 33, and hence within line 32 is subjected to a supply pressure, for example about 6 bar. The storage tank 33 is supplied from a tank 36, and a supply pump 35 through a line 34. A pressure limiting valve 37 limits the supply pressure to a predetermined level, for example 6 bar. A slider valve 38, to be described below in connection with FIG. 3 and Piezo-electrically operated is interposed between the lines 30, 31.

Similar to the above described arrangement, the pair of injection valve-pump combinations 13, 14 are connected over lines 39, 40, a slider valve 38 to a combination supply and recirculating or drain line 41, which, in turn, is connected to the supply pressure tank 33. The pump 35 is driven in any suitable manner, for example and as shown directly from the engine cam shaft 6.

FIG. 2, collectively, graphically shows the stroke-ordinate of the respective cams with respect to angular deflection, in degrees, of the cam shaft. The sections denoted A illustrate the pressure phases for the pump pistons 7 and 8, and 10 and 9, respectively. The region which is cross-hatched and shown at B denotes a range in which the respective drive cam rotates without, however, moving the associated piston of the pump. The two FIGS. 2A and 2B are drawn in vertical alignment. It is clearly apparent that during the operating phase A of the cylinder 2 (or 3), respectively, as shown in FIG. 2B is placed within the region of no movement of the cylinder 1 (or 4), which form the cylinder pairs to which the lines 30, 31 (or 39, 40) are, respectively, connected. A safety gap formed by the angle $\alpha$ is maintained on either side of the cam during the injection phase with respect to the cam controlling the other cylinder of the pair which then is in the unoperated phase B—compare FIGS. 2A and 2B.

The electrically controlled valve, with reference to FIG. 3: The control valve 38, which is a slider valve, is part of a piezo-hydraulic control block 42. The housing structure 43 of block 42 has a cylinder bore 44 therein within which a valve spool 45 is slideably retained. The terminal ends of the bore 42 are closed off by sealing threaded plugs 46, each having an engagement, or abutment projection 47. As best seen in FIG. 3, a pressure chamber 48 is located between the left closing plug 46 and the spool 45; similarly, a pressure chamber 49 is formed between the right closing plug 46 and the spool 45. The slider 45 is formed with ring-shaped recesses 50 and 51. Adjacent its ends, it is formed with two grooves 52, 53, likewise extending in ring-shaped around the slider. The recess 51 and the grooves 52, 53 are connected by an axially extending equalization bore 54. Two ring grooves 55, 56 are formed in the wall of the bore 44. The ring grooves are so located that they can be selectively opened or closed upon movement of the slider spool. The connecting ducts 30, 31—or, respectively, when the valve is used for the right pair of injection nozzles 13, 14, lines 39, 40—terminate in the ring grooves 55, 56. The common line 32, or 41, respectively, see FIG. 1, is branched to form an internal duct 57 which terminates within the region of the ring recesses or grooves or constrictions 50, 51 of the spool 45. The two branches 57 are so located that they are in communication with the recess or constriction 50, 51 of the spool regardless of the position of the spool. The terminating end of the connecting ducts 30, 31 and 39, 40, respectively, are closed in one position of the spool 45, while they are opened in the other position.

The spool 45 is moved hydraulically under control of an electric-hyraulic positioning arrangement. The block 42 includes, additionally, a further cylinder 58, for example formed as a bore in the block. The cylinder 58 retains a piston 59 therein which subdivides the cylinder 58 into a left pressure chamber 60 and a right pressure chamber 61. Piston 59 is securely connected by a pin or bore 62 with a piezo-electric driver and positioning element 63. The driver or positioning element 63 comprises a stacked column of piezo-electric discs. The far size of the driver 63, at the left of FIG. 3, is securely connected to the housing 43 by a bolt 64. Electrical connection to the piezo-electric driver 63 is obtained by a cable 67 passed through a bore 66 filled with an insulating compound 65. The cable 57 can be energized from an electrical, electronic control unit—not shown. The cylindrical bore 58 is closed by a closure plug 68, threaded in a suitably top opening, as shown in 69, in the housing 43, and sealingly pressed against a sealing abutment 70. A duct 71 is formed in the sealing plug 68 which extends through the closure element 68 to a ring groove 72 which is in matching alignment with a duct 73 leading to the pressure space 49 in the bore 44 within which slider spool 45 operates. Thus, the pressure spaces 49 and 61 are connected hydraulically. Connection of the pressure space 48 to the cylinder portion or pressure space 60 is obtained through a duct 74 within the housing 43.

Fluid fuel, in the example diesel oil or diesel fuel is retained within all chambers, ducts and spaces of the structure 43. Thus, the bore 44 within which the spool 45 operates, the equalization bore 54, the single supply-and-overflow lines 32, 41 and the branched line 57, as well as the connecting ducts 30, 31—and 39, 40, as aplicable, respectively, are filled with fuel. The gaps C between the cylinder bore 44 and the slider 5, together with the equalization bore 54 provide for compensation due to possible leakage losses from the pressure spaces, so that possible losses due to leakage in the pressure spaces are always compensated and supplied by fuel from the pre-pressurized fuel supply tank 33.

Operation: Upon application of a voltage between the piezo-electric discs of the driver—that is, energization of line 67 with respect to the metallic housing which, for example, forms the second terminal of the driver—the piston 59 is driven to the right, and thus decreases the volume of the pressure chamber 61. Fuel is thus pressed through ducts 71, 73 within chamber 49 and moves the slider 45 towards the left, that if, to its left terminal position on the abutment pin or bolt 47. Ducts 30, 31 and 39, 40, respectively are closed. Piston 59 has a much larger diameter than spool 45 to provide stroke amplification.

Let us now look at the position of the cams 2 and 3, driving the injection pumps 11, 12—see FIG. 1: The piston 7 will remain in its lowest position, and piston 8 will then just be pressed downwardly. If, in this phase of the pressure cycle, the connecting duct 31 is closed, piston 8 will press fuel through the injection valve 28. To terminate injection, voltage on the driver 63 is disconnected. This increases the cylinder space 61, and decreases the cylinder space 60. Consequently, the pressure will drop in the cylinder spaces 61 and 49, whereas the pressure will rise in the cylinder spaces 60, 48. To compensate this differential pressure, slider spool 45 will move to the right, that is, to its right terminal position in engagement with the abutment pin or bolt 47 of the right closure plug 46. This opens the communication line 31, and injection pressure in the space 29 of the valve 12 will drop. Injection is terminated.

Subsequently, the space 29 of the injection nozzle-pump arrangement of pump 12 will decrease to its minimum, whereas the pump cylinder of the injection pump 11 will increase, since piston 7 will reach the depressed position of the cam 2, and will be moved upwardly by a spring 19. Upward movement of the piston 7 results in suction being applied to fuel in lines 32, and 30, respectively, to fill the space 29 at the topmost position of the piston 7.

The next pressure stoke will be applied by the cam 5 of the injector 14, which presses the piston 10 downwardly. As soon as the communicating duct 40 is closed—under control of the piezo-electric positioning element—injection will commence through the injection nozzle 28 under control of the injection pump element 14. The injection valve pump element 13, connected to the same valve unit 38 previously had filled its operating space 29 with fuel; the piston 9, however, will remain in the uppermost, or OFF position.

This alternate operation of injection stroke—filling stroke of paired valves, with offset between the respective paired injectors 7, 8; 9, 10, between the respective pressure or ON phases and the quiascent, or OFF phases will then continue cyclically, with the safety margin between ON and OFF phases, as explained in connection with FIG. 2A, being maintained.

The system, thus, permits accurately timed control of initiation and termination of fuel injection by movement of the slider, or spool 45, independently of the injection pressure, which is controlled by the fuel within the respective spaces 29 of the cylinders 24–27 of the injectors 11–14, under control of the cams 2–5.

Various changes and modifications may be made within the scope of the inventive concept.

The invention has been described in connection with structurally combined fuel injection pump-nozzle arrangements. It is not necessary that the nozzles 28 are physically joined to the end portions of the respective cylinders 24–27; connection lines between the bottom walls of the cylinders 24–27 can be provided for connection to suitable injectors. Preferably these lines should be of equal lengths, and short. In such a case, the bottom wall of the cylinders 24–27 should be placed where the upper end portion of the nozzle 28 is located, as shown in FIG. 1.

I claim:

1. Pressurized fuel injection system for a multi-cylinder internal combustion engine, particularly multi-cylinder diesel engine fuel injection system having a plurality of injection valves (11–14) each injection valve having a valve piston (7–10) operable in a respective valve cylinder (24–27);

timed mechanical drive means (2–5) coupled (15–23) to a crank shaft (6) of the engine, and to the valve pistons for reciprocating the valve pistons;

a fuel supply system (33–37) providing fuel from a tank (36);

a connection line (30, 31; 33, 40; 32, 41) from the fuel supply system to the injection valves;

and an electrically controlled control valve (38, 42) hydraulically connected into the connection lines between the fuel supply system and the injection valves, wherein, in accordance with the invention the control valve (38, 42) comprises a spool valve having a valve spool (45) moveable between first and second positions, respectively placing the connection lines (30, 31; 39, 40) of at least two injection valves (11, 12; 13, 14) either in open, hydraulically communicating, or closed, hydraulically blocking state;

electrically controlled positioning control means (59, 63) moving said valve spool between the respective first and second positions;

and wherein the mechanical drive means (2–5) are so coupled to the valve pistons of the at least two injection valves (11, 12; 13, 41) and are, respectively, so timed that during an injection pulse, only one of the valve pistons (7 or 8; 9 or 10) of the at least two injection valves (11, 12; 13, 14) is moved to provide for fuel injection therefrom, the electrically controlled piston control means (59, 63) controlling, respectively, blocking, and unblocking of hydraulic communication between the fuel supply system and the at least two valves, controlled by the electrically controlled positioning control means of the connecting lines to unblocked, or hydraulically communicating state permitting overflow of fuel from the respective valve through the respective communicating lines even during occurance of operation of the mechanical drive means to move the respective piston in a direction to expel fuel from the respective cylinder of the respective valve.

2. System according to claim 1 wherein the electrically controlled positioning control means comprises a piezo-electrical positioning element (63).

3. System according to claim 2 wherein the piezo-electrical positioning element (63) is coupled to a hydraulic servo piston (59) which is operating in a cylinder (58) hydraulically coupled to move the spool (45) of the spool valve.

4. System according to claim 1 wherein the hydraulic connecting lines (32, 41; 30, 31; 39, 40) between the fuel supply system and the injection valves are single lines forming, simultaneously, fuel supply and overflow or drain line.

5. System according to claim 1 wherein the mechanical drive means (2–5) comprise drive cams which have cam lands shaped to maintain the pressure stroke of the pistons (7–10) coupled to the respective cams at a constant level over essentially the entire injection range (A) during stroke of the piston upon rotation of the cam;

and said cams include an OFF range beyond said lands (B) which is larger than the injection range lands (A);

and wherein the cams (2,3; 4, 5) of the at least two injection valves (11, 12; 13, 14) associated with a single control valve (38, 42) are so offset with respect to each other, that the land of one cam controlling the range of injection (A) corresponds to the OFF cam position of the cam controlling the other injection valve or valves of said at least two injection valves associated with a single control valve (38, 42).

6. System according to claim 5 wherein the land controlling the injection range (A) of a cam trailing the cam of another one of the at least two injection valves is positioned within the OFF-cam, or land position of the leading cam, and wherein the term "trailing" and "leading" relate to, respectively, angular positions of the cam shaft with respect to the direction of rotation thereof.

7. System according to claim 1 wherein the spool valve comprises a piezo-hydraulic control block (42)

having a cylinder (44) therein, said valve spool (45) being operative within said cylinder between two (right, left) terminal positions;

pressure chambers (48, 49) being formed adjacent the end faces of the valve spool;

an equalization bore (54) formed within the valve slider extending axially therethrough;

and communication grooves (53) in hydraulic communication with said communication bore (54) located in the valve spool behind the end faces thereof, the equalization bore (54) providing for equalization of leakage fluid leaking around the end faces and between the end faces and the walls of the spool cylinder (54).

8. System according to claim 7 wherein said fluid supply system includes a fluid pump (35) and a reservoir, providing pressure fluid to said lines at a pressure in the order of about 6 bar.

9. System according to claim 7 wherein the electrically controlled positioning control means comprises a piezo-electric driver (63);

and said control block (42) includes a control piston (59) mechanically coupled to the piezo-electric driver and moved thereby;

a control cylinder (58) within which said piston is moveable, said piston subdividing said cylinder into two cylinder chambers (60, 61) at either side of said piston;

connecting lines (71, 73; 74) connecting the respective cylinder chambers (61, 60) to the cylinder bore (44) of the spool valve at the end portions thereof and into chambers (48, 49) outside of the terminal ends of the slider spool (45);

said slider spool (45) having a substantially smaller diameter than the piston (59) coupled to the piezo-electric driver;

and wherein the spool (45) has two constricted regions (50, 51) in its central portion between the end faces thereof;

connection lines (57) extending to the region of said constricted zones (50, 51) and being in continuous communication therewith, and coupled to said fuel supply system;

and wherein the connecting lines (30, 31; 39, 40) terminate in the walls of the cylinder bore (44) of the spool valve in regions where the spool valve, in one position, closes off communication of said connecting lines with the lines (57) to the fuel supply system, and in another position, establishes communication therewith.

* * * * *